US006918755B1

(12) United States Patent
Johnson et al.

(10) Patent No.: US 6,918,755 B1
(45) Date of Patent: Jul. 19, 2005

(54) FUEL-FIRED BURNER WITH SKEWED ELECTRODE ARRANGEMENT

(75) Inventors: Randall J. Johnson, Greenwood, IN (US); Wilbur H. Crawley, Columbus, IN (US); Stephen P. Goldschmidt, Westport, IN (US)

(73) Assignee: Arvin Technologies, Inc., Troy, MI (US)

( * ) Notice: Subject to any disclaimer, the term of this patent is extended or adjusted under 35 U.S.C. 154(b) by 15 days.

(21) Appl. No.: 10/894,548

(22) Filed: Jul. 20, 2004

(51) Int. Cl.[7] ..... F23D 3/40
(52) U.S. Cl. ..... 431/7; 431/264; 431/285
(58) Field of Search ..... 431/7, 10, 264, 431/284, 285, 326; 123/241; 60/275, 288; 110/165 R; 96/69, 98

(56) References Cited

U.S. PATENT DOCUMENTS 3,503,348 A * 3/1970 Dvirka ..... 110/216
3,765,153 A * 10/1973 Grey ..... 96/48
3,924,547 A * 12/1975 Werner ..... 110/192
3,985,524 A * 10/1976 Masuda ..... 96/32
4,018,577 A * 4/1977 Shibuya et al. ..... 96/78
4,084,164 A 4/1978 Alt et al.
4,111,636 A * 9/1978 Goldberg ..... 431/2
4,541,847 A 9/1985 Oie et al.
4,549,887 A 10/1985 Joannou
4,581,046 A 4/1986 Bergman
4,623,365 A 11/1986 Bergman
4,652,281 A 3/1987 Masuda et al.
4,654,054 A 3/1987 Snaddon et al.
4,662,903 A 5/1987 Yanagawa
4,759,778 A 7/1988 Conrad
4,828,586 A 5/1989 Joannou
4,871,495 A 10/1989 Helferich et al.
4,898,105 A 2/1990 Rappoldt et al.
4,954,320 A 9/1990 Birmingham et al.
4,969,328 A 11/1990 Kammel
4,976,760 A 12/1990 Helferich et al.
5,009,683 A 4/1991 Sun
5,022,975 A 6/1991 Gordon
5,055,030 A * 10/1991 Schirmer ..... 431/10
5,059,218 A 10/1991 Pick
5,097,665 A 3/1992 Kammel
5,108,470 A 4/1992 Pick
5,170,188 A 12/1992 Bowers et al.
5,276,490 A 1/1994 Bartholmae et al.
RE34,549 E 2/1994 Sun
5,322,537 A 6/1994 Nakamura et al.
5,368,635 A 11/1994 Yamamoto
5,551,869 A * 9/1996 Brais et al. ..... 431/285
5,555,862 A 9/1996 Tozzi
5,557,923 A 9/1996 Bolt et al.
5,573,577 A 11/1996 Joannou
5,582,632 A 12/1996 Nohr et al.
5,593,476 A 1/1997 Coppom
5,619,959 A 4/1997 Tozzi
5,647,890 A 7/1997 Yamamoto
5,702,244 A * 12/1997 Goodson et al. ..... 431/2
5,758,495 A 6/1998 Serra
5,807,425 A 9/1998 Gibbs
5,855,653 A 1/1999 Yamamoto (Continued)

*Primary Examiner*—Stephen Gravini
(74) *Attorney, Agent, or Firm*—Barnes & Thornburg

(57) ABSTRACT

A fuel-fired burner for use with an emission abatement device comprises a pair of electrodes. Each electrode comprises an arc-contact rod to generate an electrical arc therebetween.

20 Claims, 6 Drawing Sheets

U.S. PATENT DOCUMENTS

| | | | | |
|---|---|---|---|---|
| 5,906,677 | A | 5/1999 | Dudley | |
| 6,058,698 | A | 5/2000 | Coral et al. | |
| 6,077,334 | A | 6/2000 | Joannou | |
| 6,112,519 | A | 9/2000 | Shimasaki et al. | |
| 6,119,455 | A | 9/2000 | Hammer et al. | |
| 6,231,643 | B1 | 5/2001 | Pasic et al. | |
| 6,235,090 | B1 | 5/2001 | Bernstein et al. | |
| 6,290,757 | B1 | 9/2001 | Lawless | |
| 6,294,004 | B1 | 9/2001 | Summers et al. | |
| 6,391,267 | B1 * | 5/2002 | Martin et al. | 422/173 |
| 6,553,981 | B1 | 4/2003 | Suckewer et al. | |
| 6,568,362 | B2 | 5/2003 | Whealton et al. | |
| 6,572,685 | B2 | 6/2003 | Dunshee | |
| 6,646,377 | B2 | 11/2003 | Hashimoto | |
| 6,680,037 | B1 | 1/2004 | Allansson et al. | |
| 2002/0152890 | A1 | 10/2002 | Leiser | |
| 2002/0185096 | A1 | 12/2002 | Whealton et al. | |
| 2003/0037676 | A1 | 2/2003 | Dunshee | |
| 2003/0079609 | A1 | 5/2003 | Lobiondo, Jr. | |
| 2003/0110944 | A1 | 6/2003 | Wu et al. | |
| 2003/0164095 | A1 | 9/2003 | Joannou | |
| 2003/0182930 | A1 | 10/2003 | Goulette et al. | |
| 2003/0196428 | A1 | 10/2003 | Iida et al. | |
| 2003/0233824 | A1 | 12/2003 | Chun et al. | |

* cited by examiner

FUEL-FIRED BURNER WITH SKEWED ELECTRODE ARRANGEMENT

FIELD OF THE DISCLOSURE

The present disclosure relates generally to fuel-fired burners for use with emission abatement devices.

BACKGROUND OF THE DISCLOSURE

Untreated internal combustion engine emissions (e.g., diesel emissions) include various effluents such as $NO_X$, hydrocarbons, and carbon monoxide, for example. Moreover, the untreated emissions from certain types of internal combustion engines, such as diesel engines, also include particulate carbon-based matter or "soot". Federal regulations relating to soot emission standards are becoming more and more rigid thereby furthering the need for devices and/or methods which remove soot from engine emissions.

The amount of soot released by an engine system can be reduced by the use of an emission abatement device such as a filter or trap. Such a filter or trap is periodically regenerated in order to remove the soot therefrom. The filter or trap may be regenerated by use of a burner to burn the soot trapped in the filter.

SUMMARY

According to an aspect of the present disclosure, there is a fuel-fired burner for use with an emission abatement device (e.g., a soot abatement device). The fuel-fired burner comprises first and second electrodes. Each electrode comprises a straight arc-contact rod having a longitudinal axis. The arc-contact rods are spaced apart to generate an electrical arc therebetween and are non-parallel. The longitudinal axes of the arc-contact rods are non-intersecting. As such, the arc-contact rods are "skewed" relative to one another. In an exemplary embodiment, the arc-contact rods cooperate to define an X-shaped arrangement when viewed in side elevation.

The above and other features of the present disclosure will become apparent from the following description and the attached drawings.

BRIEF DESCRIPTION OF THE DRAWINGS

The detailed description particularly refers to the following figures in which.

DETAILED DESCRIPTION OF THE DRAWINGS

Figure 1:
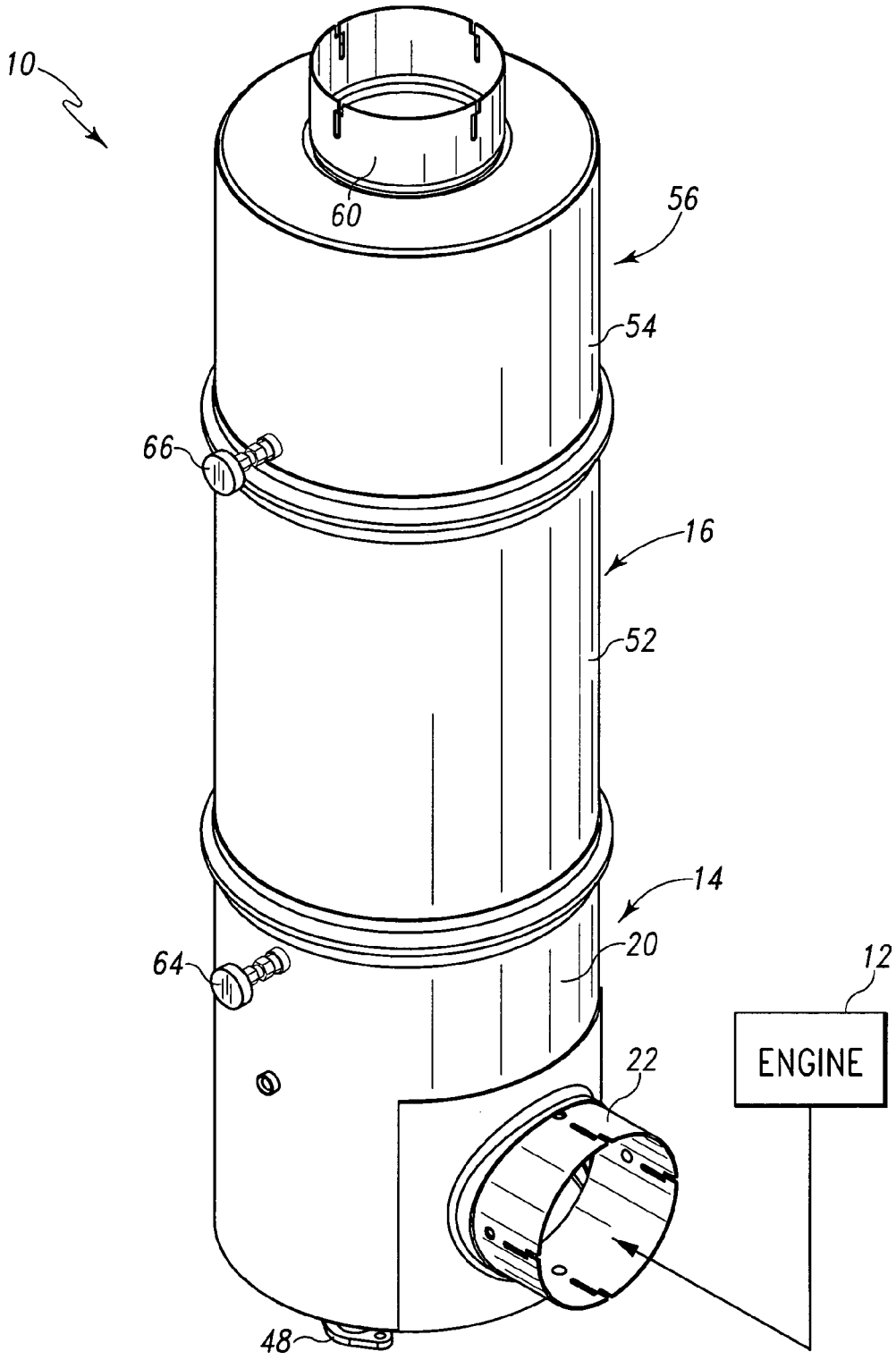
FIG. 1 is a perspective view of an emission abatement device for reducing emissions such as soot from exhaust gas discharged from a diesel engine.

While the concepts of the present disclosure are susceptible to various modifications and alternative forms, specific exemplary embodiments thereof have been shown by way of example in the drawings and will herein be described in detail. It should be understood, however, that there is no intent to limit the disclosure to the particular forms disclosed, but on the contrary, the intention is to cover all modifications, equivalents, and alternatives following within the spirit and scope of the invention as defined by the appended claims.

Figure 2:
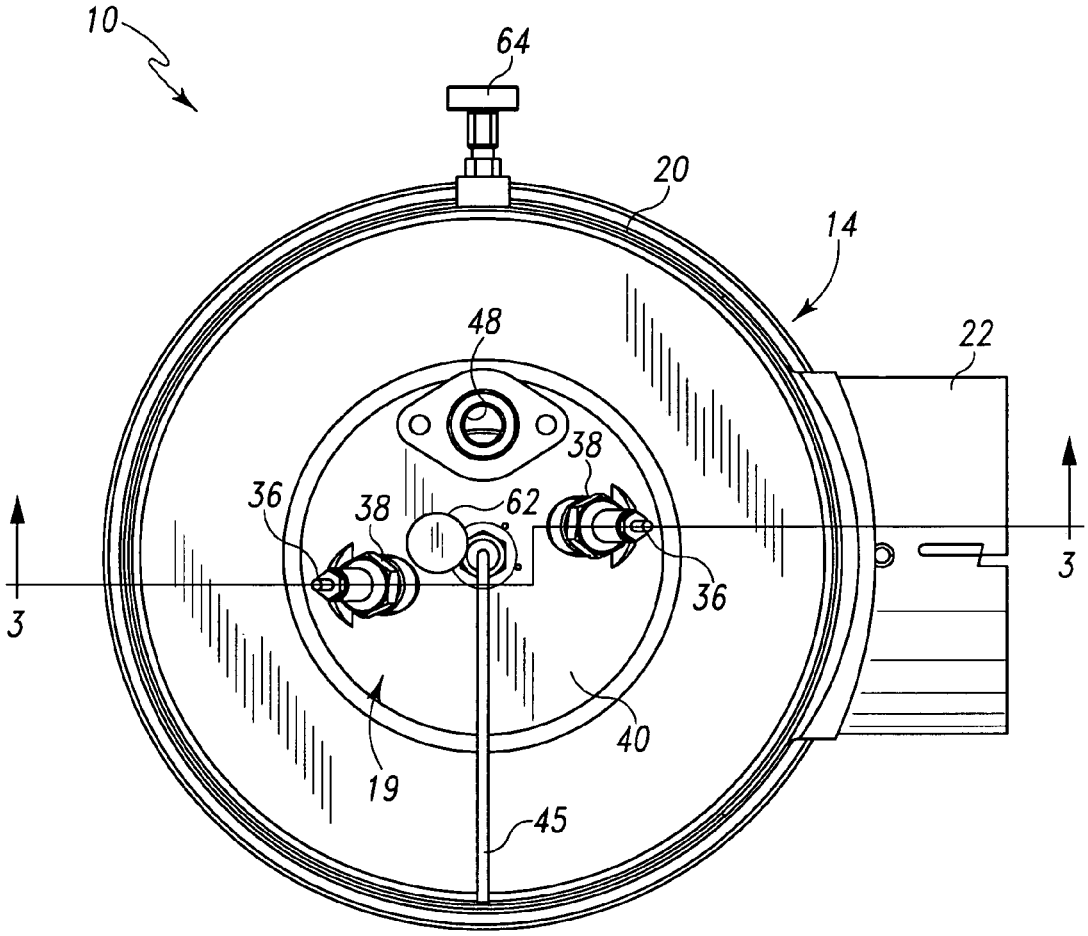
FIG. 2 is a bottom view of the emission abatement device.
Figure 3:
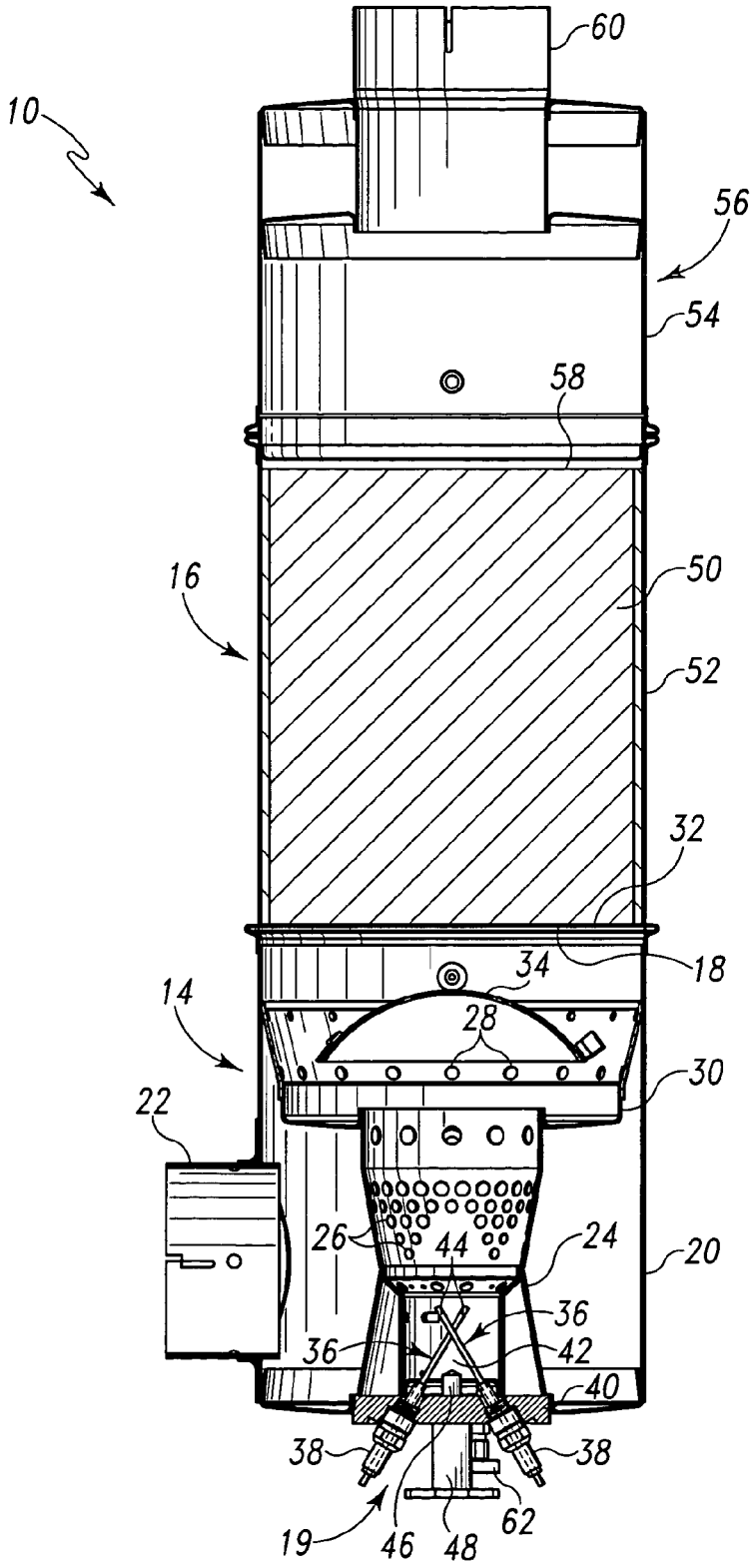
FIG. 3 is a sectional view taken along lines 3—3 of FIG. 2 showing a burner fluidly coupled to an inlet face of a soot trap for burning off soot particles trapped by the soot trap.

An emission abatement device 10 for use with an internal combustion engine 12 (i.e., a diesel engine) is provided for treatment of emissions in exhaust gas discharged from the engine 12, as shown, for example, in FIGS. 1–3. The emission abatement device 10 is configured, for example, as a soot abatement device for removing soot from the exhaust gas. The device 10 comprises a fuel-fired burner 14 and a soot trap 16. The fuel-fired burner 14 is positioned upstream (relative to exhaust gas flow from the engine 12) from the soot trap 16 so as to be fluidly coupled to an inlet face 18 of the soot trap 16. During operation of the engine 12, exhaust gas flows through the soot trap 16 thereby trapping soot in the soot trap 16. Treated exhaust gas may subsequently be released into the atmosphere. From time to time during operation of the engine 12, the fuel-fired burner 14 is operated to regenerate the soot trap 16 so as to burn off soot trapped therein. As discussed in more detail herein, an electrode assembly 19 of the burner 14 is configured to promote efficient combustion of an air-fuel mixture in the device 10.

Referring to FIG. 3, the burner 14 comprises a burner housing 20. Exhaust gas discharged from the engine 12 enters the burner housing 20 through an exhaust gas inlet port 22. The exhaust gas that has entered the burner housing 20 is permitted to flow into a combustion chamber 24 of the burner housing 20 through gas inlet openings 26 defined in the combustion chamber 24. In such a way, an ignition flame present inside the combustion chamber 24 is protected from the full engine exhaust gas flow, while controlled amounts of engine exhaust gas are permitted to enter the combustion chamber 24 to provide oxygen to facilitate combustion of the fuel supplied to the burner 14. Exhaust gas not entering the combustion chamber 24 is directed through a number of openings 28 defined in a shroud 30 and out an outlet 32 of the burner housing 20. A flame holder 34 located in the shroud 30 holds the ignition flame adjacent to the inlet face 18 of the soot trap 16.

The electrode assembly 19 comprises a pair of electrodes 36 and a pair of electrode casings 38. Each electrode casing 38 surrounds a portion of a respective one of the electrodes 36 to electrically insulate that electrode 36 and mount that electrode 36 to a mount plate 40. When electric power is applied to the electrodes 36, an arc is generated in an electrode gap 42 between straight arc-contact rods 44 of the electrodes 36. Fuel supplied by a fuel line 45 enters the fuel-fired burner 14 through a fuel nozzle 46 and is advanced through the gap 42 between the arc-contact rods 44 thereby causing the fuel to be ignited by the arc generated by the arc-contact rods 44. It should be appreciated that the fuel entering the nozzle 46 is generally in the form of a controlled air/fuel mixture. The arrangement of the arc-contact rods 44 is discussed in more detail herein.

The fuel-fired burner 14 also comprises a combustion air inlet 48. During regeneration of the soot trap 16, a flow of pressurized air is introduced into the burner 14 through the combustion air inlet 48 to provide oxygen (in addition to oxygen present in the exhaust gas) to sustain combustion of the fuel.

The soot trap 16 is positioned downstream (relative to exhaust gas flow) from the burner housing outlet 32. The soot trap 16 includes a filter substrate 50. The substrate 50 is positioned in a trap housing 52. The trap housing 52 is secured to the burner housing 20. As such, gas exiting the burner housing 20 is directed into the trap housing 52 and through the substrate 50. The soot trap 16 may be any type of commercially available soot trap. For example, the soot trap 16 may be embodied as any known exhaust soot trap such as a "deep bed" or "wall flow" filter. Deep bed filters may be embodied as metallic mesh filters, metallic or ceramic foam filters, ceramic fiber mesh filters, and the like. Wall flow filters, on the other hand, may be embodied as a cordierite or silicon carbide ceramic filter with alternating channels plugged at the front and rear of the filter thereby forcing the gas advancing therethrough into one channel, through the walls, and out another channel. Moreover, the substrate 50 may be impregnated with a catalytic material such as, for example, a precious metal catalytic material. The catalytic material may be, for example, embodied as platinum, rhodium, palladium, including combinations thereof, along with any other similar catalytic materials. Use of a catalytic material lowers the temperature needed to ignite trapped soot particles.

The trap housing 52 is secured to a housing 54 of a collector 56. Specifically, an outlet 58 of the trap housing 52 is secured to an inlet 60 of the collector housing 54. As such, processed (i.e., filtered) exhaust gas exiting the substrate 50 (and hence the trap housing 52) is advanced into the collector 56. The processed exhaust gas is then discharged from the collector 56 through gas outlet port 60 for eventual release to atmosphere. It should be appreciated that the gas outlet port 60 may be coupled to the inlet (or a pipe coupled to the inlet) of a subsequent emission abatement device (not shown).

The device 10 comprises a number of sensors for use in controlling operation of the burner 14. For example, the device 10 comprises a flame temperature sensor 62, a control temperature sensor 64, and an outlet temperature sensor 66. The temperature sensors 62, 64, 66 are electrically coupled to an electronic controller (not shown) and, as shown in FIGS. 1 and 2, may be embodied as thermocouples which extend through the housings of the device 10 although other types of sensors may also be used.

As mentioned in the discussion above, the electrode assembly 19 is arranged to promote efficient combustion of an air-fuel mixture in the combustion chamber 24. In particular, the arc-contact rods 44 are "skewed" so that the size of the electrode gap 42 varies along the lengths of the arc-contact rods 44 to promote stretching or lengthening of the arc generated in the electrode gap 42 thereby increasing the chances that the arc will encounter an air-fuel mixture region having an air-to-fuel ratio suitable for ignition. Such stretching or lengthening of the arc can occur when the arc travels along the arc-contact rods 44 due to turbulence in the combustion chamber 24.

Figure 5:
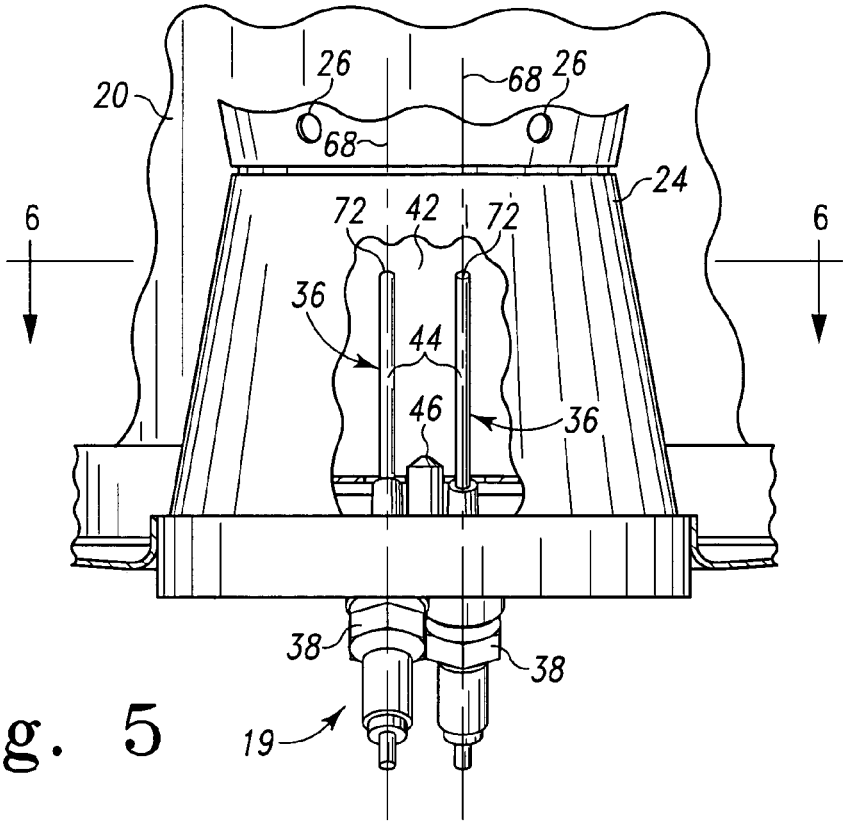
FIG. 5 is a rear elevation view showing an electrode gap between the arc-contact rods.
Figure 6:
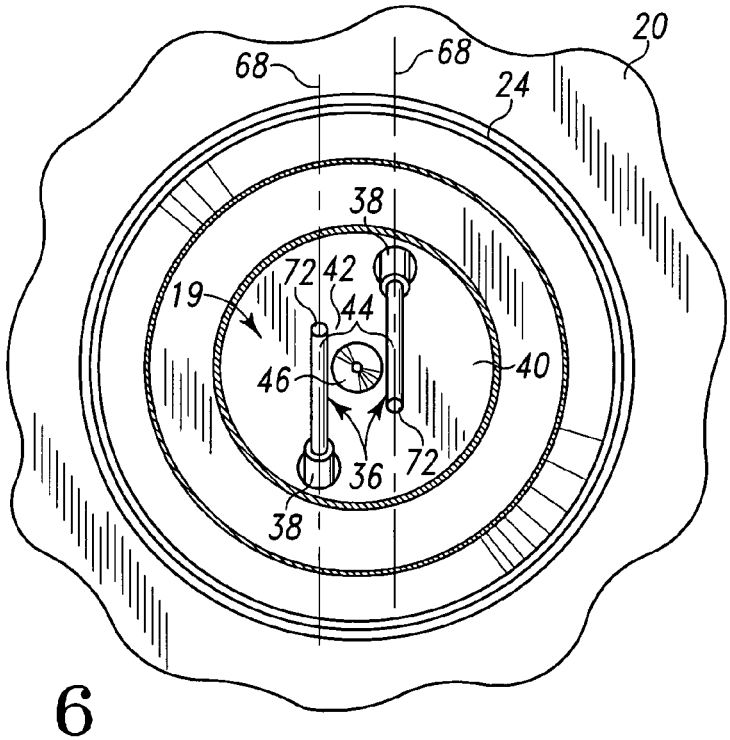
FIG. 6 is a sectional view taken along lines 6—6 of FIG. 5.

The arc-contact rods 44 are skewed in the sense that they are spaced apart, non-parallel, and have non-intersecting longitudinal axes 68. The longitudinal axes 68 are non-intersecting in the sense that, although they are infinitely extending imaginary lines, they never intersect (i.e., pass through) one another, as shown, for example, in FIGS. 5 and 6. As such, the longitudinal axes 68 do not lie on a common plane.

Figure 4:
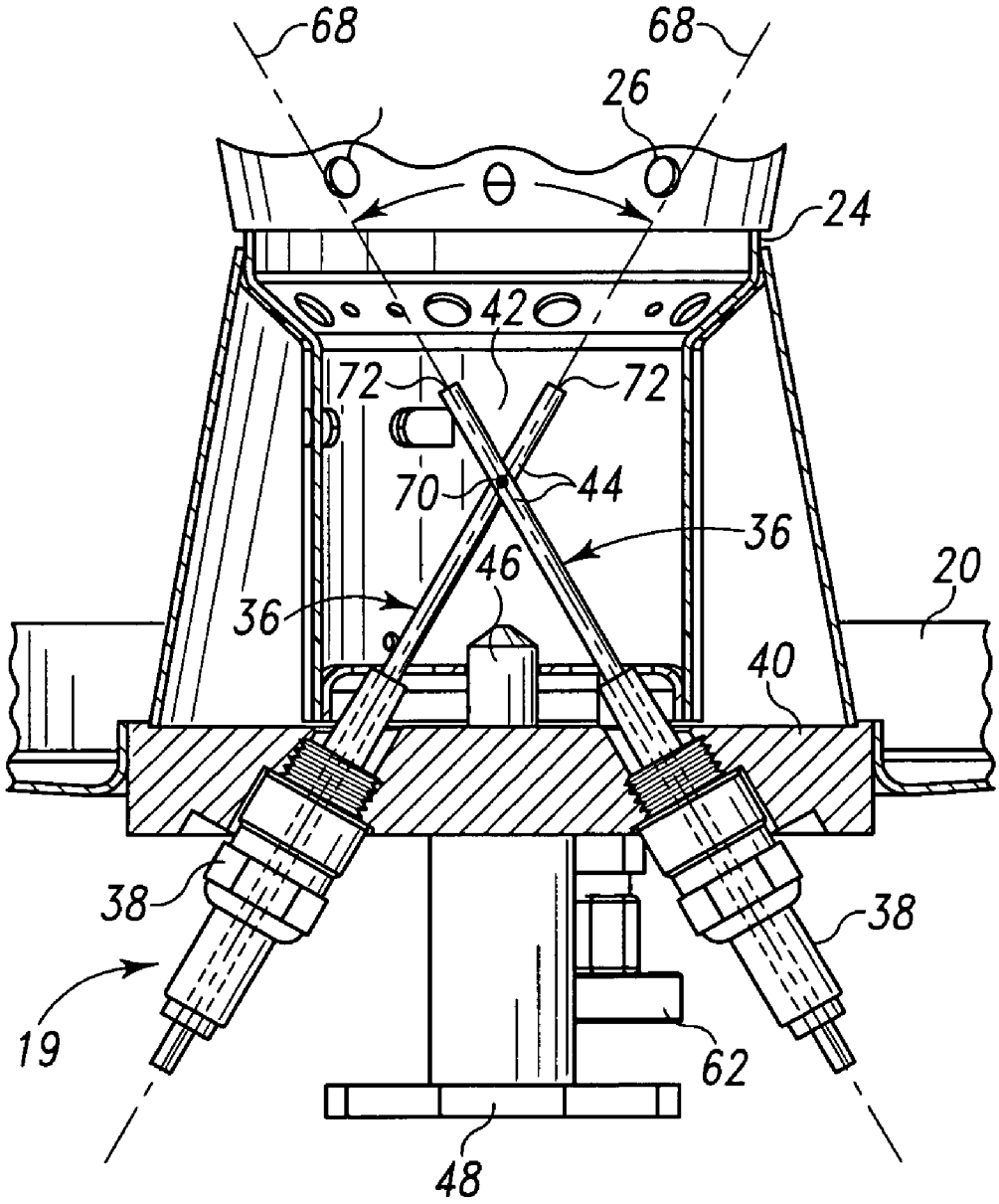
FIG. 4 is a side elevation view of an enlarged detail of the burner of FIG. 3 showing a pair of electrodes comprising a pair of arc-contact rods that define an X-shaped arrangement when viewed in side elevation and that form an acute angle between one another.
Figure 7:
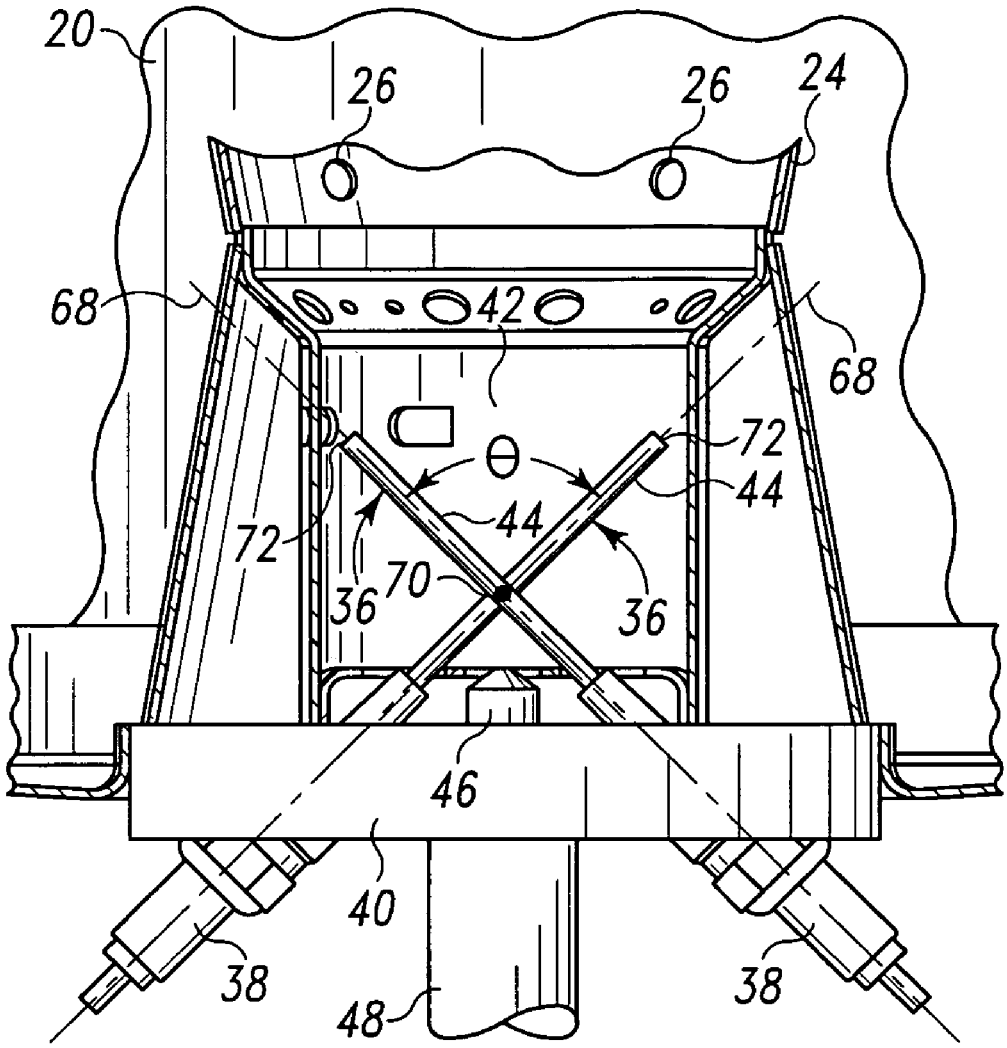
FIG. 7 is a side elevation view showing the arc-contact rods at right angles to one another.

A first example of such a skewed arrangement is shown in FIGS. 3–6 and a second example of such a skewed arrangement is shown in FIG. 7. In both examples, the arc-contact rods 44 cooperate to define an X-shaped arrangement when viewed in side elevation, as shown in FIGS. 3 and 4 with respect to the first example and as shown in FIG. 7 with respect to the second example. Both X-shaped arrangements have a crossover point 70 at which the arc-contact rods 44 cross over one another. In the X-shaped arrangements, the electrode gap 42 decreases as the arc-contact rods 44 extend from the casings 38 to the crossover point 70 and increases as the arc-contact rods 44 extend from the crossover point 70 to free ends 72 of the arc-contact rods.

The crossover point 70 may be located at a variety of locations along the lengths of the arc-contact rods 44. For example, the crossover point 70 may be located farther from the casings 38 than the center points of the arc-contact rods 44 (i.e., between the center points of the rods 44 and the free ends 72 thereof) as in the first example of the skewed arrangement or may be located at the center points of the arc-contact rods 44 as in the second example of the skewed arrangement. Such positioning of the crossover point 70 promotes generation of the arc between the arc-contact rods 44 rather than between one of the arc-contact rods 44 and structures located near the casings 38. With respect to the first example of the skewed arrangement, arc-contact rod distal portions 74 (which extend from the crossover point 70 to the free ends 72) are half the length of arc-contact rod proximal portions 76 (which extend from the casings 38 to the crossover point 70).

The distal portions 74 of the arc-contact rods 44 form an angle θ therebetween when viewed in side elevation. The distal portions 74 define an acute angle therebetween in the first example of the skewed arrangement and define a right angle therebetween in the second example of the skewed arrangement. The first example allows for more travel of the arc along the arc-contact rods 44 whereas the second example allows for more arc-stretching per unit length of travel along arc-contact rods 44.

The fuel nozzle 46 is positioned between the arc-contact rods 44. In particular, when viewed in side elevation as in FIGS. 4 and 7, the fuel nozzle 46 is positioned between the crossover point 70 and the mount plate 40 for flow of fuel through the electrode gap 42 on both sides of the crossover point 70.

The arc-contact rods 44 are cylindrical to promote generation of the arc therebetween. In the two illustrated examples, the arc-contact rods 44 are shaped as a circular cylinder. It is within the scope of this disclosure for the arc-contact rods 44 to be shaped as a square cylinder, a triangle cylinder, an elliptical cylinder, and the like.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the apparatus, method, and system described herein. It will be noted that alternative embodiments of the present disclosure may not include all of the features described yet still benefit from at least some of the advantages of such features. Those of ordinary skill in the art may readily devise their own implementations of an apparatus, method, and system that incorporate one or more of the features of the present disclosure and fall within the spirit and scope of the present invention as defined by the appended claims.

What is claimed is:

1. A fuel-fired burner for use with an emission abatement device, the fuel-fired burner comprising:

first and second electrodes, each electrode comprising an arc-contact rod, the arc-contact rods being spaced apart to generate an electrical arc therebetween and cooperating to define an X-shaped arrangement when viewed in side elevation.

2. The fuel-fired burner of claim 1, wherein the X-shaped arrangement has a crossover point at which the arc-contact rods cross over one another, and the crossover point is off center from the center points of the arc-contact rods.

3. The fuel-fired burner of claim 2, comprising an electrode casing surrounding a portion of each electrode, wherein the crossover point is located farther from the electrode casings than the center points of the arc-contact rods.

4. The fuel-fired burner of claim 1, wherein the X-shaped arrangement has a crossover point at which the arc-contact rods cross over one another, and the crossover point is located at the center points of the arc-contact rods.

5. The fuel-fired burner of claim 1, comprising a fuel nozzle positioned between the arc-contact rods and a mount plate to which the fuel nozzle and the electrodes are secured, wherein the X-shaped arrangement has a crossover point at which the arc-contact rods cross over one another, and, when viewed in side elevation, the fuel nozzle is positioned between the crossover point and the mount plate.

6. The fuel-fired burner of claim 1, wherein the arc-contact rods define an acute angle therebetween when viewed in side elevation.

7. The fuel-fired burner of claim 6, comprising an electrode casing surrounding a portion of each electrode, wherein the X-shaped arrangement has a crossover point at which the arc-contact rods cross over one another, each arc-contact rod comprises a proximal portion extending from a respective one of the electrode casings to the crossover point and a distal portion extending from the crossover point to a free end of the arc-contact rod, and the acute angle is defined between the distal portions.

8. The fuel-fired burner of claim 1, wherein the arc-contact rods define a right angle therebetween when viewed in side elevation.

9. A soot abatement device comprising:

a soot trap, and a fuel-fired burner fluidly coupled to an inlet face of the soot trap, the fuel-fired burner comprising first and second electrodes, each electrode comprising an arc-contact rod, the arc-contact rods being spaced apart to generate an electrical arc therebetween and cooperating to define an X-shaped arrangement when viewed in side elevation.

10. The soot abatement device of claim 9, comprising an electrode casing surrounding a portion of each electrode, wherein each arc-contact rod comprises a free end and extends from a respective one of the electrode casings to its free end, the X-shaped arrangement has a crossover point at which the arc-contact rods cross over one another, and the crossover point is either located at the center points of the arc-contact rods or located between the center points of the arc-contact rods and the free ends of the arc-contact rods in spaced-apart relation to the center points of the arc-contact rods.

11. The soot abatement device of claim 9, wherein the arc-contact rods define one of an acute angle and a right angle therebetween when viewed in side elevation.

12. A fuel-fired burner for use with an emission abatement device, the fuel-fired burner comprising:

first and second electrodes, each electrode comprising a straight arc-contact rod having a longitudinal axis, the arc-contact rods being spaced apart to generate an electrical arc therebetween and being non-parallel, the longitudinal axes of the arc-contact rods being non-intersecting.

13. The fuel-fired burner of claim 12, wherein the arc-contact rods cooperate to define an electrode gap therebetween, and the size of the electrode gap decreases and increases as the arc-contact rods extend along their longitudinal axes.

14. The fuel-fired burner of claim 13, comprising an electrode casing surrounding a portion of each electrode, wherein each arc-contact rod comprises a free end, and the size of the electrode gap first decreases and then increases as the arc-contact rods extend from the electrode casings to the free ends.

15. The fuel-fired burner of claim 12, wherein the arc-contact rods cooperate to define an X-shaped arrangement when viewed in side elevation.

16. The fuel-fired burner of claim 15, wherein the arc-contact rods define an acute angle therebetween when viewed in side elevation.

17. The fuel-fired burner of claim 15, wherein the arc-contact rods define a right angle therebetween when viewed in side elevation.

18. The fuel-fired burner of claim 12, wherein the longitudinal axes do not lie on a common plane.

19. The fuel-fired burner of claim 12, wherein each arc-contact rod is cylindrical.

20. The fuel-fired burner of claim 12, wherein each arc-contact rod is shaped as a circular cylinder.

* * * * *